United States Patent [19]

Nelson et al.

[11] 4,149,654

[45] Apr. 17, 1979

[54] DISHWASHER MULTIPLE ADDITIVE DISPENSING APPARATUS

[75] Inventors: Thomas E. Nelson, Anchorage; Thomas E. Jenkins; Donald S. Cushing, both of Louisville, all of Ky.

[73] Assignee: General Electric Company, Louisville, Ky.

[21] Appl. No.: 798,974

[22] Filed: May 20, 1977

[51] Int. Cl.[2] ..... B67D 5/08

[52] U.S. Cl. ..... 222/70; 134/93; 222/129; 222/516

[58] Field of Search ..... 222/70, 129, 164, 166, 222/167, 427, 516, 517, 531, 532; 134/95, 100, 101, 56 D, 57 D, 57 DL, 58 D, 58 DL, 93; 68/17 R, 207

[56] References Cited

U.S. PATENT DOCUMENTS

| | | | |
|---|---|---|---|
| 3,212,675 | 10/1965 | Krzewina | 134/93 X |
| 3,419,192 | 12/1968 | Wrightenberry | 222/70 X |
| 3,426,944 | 2/1969 | French | 222/167 X |

*Primary Examiner*—Robert J. Spar
*Assistant Examiner*—Fred A. Silverberg
*Attorney, Agent, or Firm*—Bruce A. Yungman; Radford M. Reams

[57] ABSTRACT

A dishwashing apparatus having two dispensers operable at preselected times in a dishwashing cycle for dispensing treating additives such as detergent and a rinse aid additive. The dispensers are arranged so that in response to a programmer-timer controlled cam an interlock device to which the detergent dispenser cover is mounted is released and the cover swings away from the dispenser container opening. The interlock includes a shaft integral with a handle used to close the dispenser cover, the other end of the shaft having a unitary detent member secured for rotation with said shaft, said detent including a plurality of latching extensions for operative engagment with the timer controlled cam. Mounted adjacent the detergent dispensing mechanism is the rinse aid dispenser which is also activated by the interlock device. One of the latching members holds the shaft from rotation until the detergent is required, and another of the latching members holds the shaft from rotation until the rinse aid is required. After a complete wash and rinse operation the rinse aid device is held in an inoperative position until the detergent cup cover is closed by the operator.

7 Claims, 5 Drawing Figures

DISHWASHER MULTIPLE ADDITIVE DISPENSING APPARATUS

CROSS REFERENCE TO RELATED MATTER

This application is related to commonly assigned copending patent applications Ser. No. 798,972, 798,932 and 798,969 filed on the same date hereof.

BACKGROUND OF THE INVENTION

The instant invention relates to washing apparatus and in particular to dispensers for dispensing a preselected quantity of detergent and rinse aid additives at preselected times into washing liquid during a washing and a rinsing operation.

Conventional dishwashers effect cleaning by means of a preselected timed sequence of wash and rinse cycles in which different additives are introduced into the dishwashing chamber. Thus, detergent may be dispensed at different times during the wash cycle and rinse additives to provide improved rinsing of the washed dishes may be dispensed during the final rinse cycle. Automatic dispensers which operate in preselected timed sequence have been provided in the past to affect these dispensing operations. For example, a common rinse aid injector in use today includes a relatively expensive solenoid to operate the metering or dispensing mechanism. Since the solenoid is used, there is also an additional switch required in the sequence control means. Moreover, the solenoid operated device does not provide selectivity of operation without the employment of a second additional switch to override the switch in the sequence control means. Selectivity, as used herein, means the ability to operate a diswasher through a full cycle with, or without, rinse aid being injected at the selection of the user. With a solenoid operated dispenser, it is necessary to position an additional selection switch in electrical series with a solenoid to override the sequence control means switch in the event it is desired to omit the dispensing during a particular wash cycle. Devices have been shown such as in U.S. Pat. No.3,198,387 whereby the operator of an automatic washing machine may select a cycle during which the dispensing means will operate by manipulating a manually operable means. This particular device, however, relates solely to a rinse aid injector independent of the detergent dispensing mechanism and therefore requires the operator to remember when to activate or not activate the rinse aid dispenser depending on which operational cycle is selected.

With most prior art devices the rinse aid dispenser was normally activated whenever the operator put the machnine in a rinse and hold cycle. This of course would release the rinse aid unnecessarily and adversely affect the rinsing operation and the later washing operation. Prior art devices are known which are relatively complex apparatus for preventing activation of the rinse aid dispenser. See for example the bimetal element and its related structure shown in commonly assigned U.S. Pat. No.3,212,675.

It would be most advantageous to provide economical dispensing structure for both detergent and rinse aid additive which would be operably interconnected such that the system would automatically prevent the operation of the rinse injector whenever the detergent is not used, such as in, what is commonly referred to as, the "rinse and hold" cycle.

SUMMARY OF THE INVENTION

The present invention involves an improved dispensing structure for dispensing detergent and rinse aid into the washing chamber of a washing machine at preselected times in the washing cycle. It is the primary objective to provide means for making operation of a simple mechanically actuated rinse aid injector dependent upon the manual resetting and subsequent operation of the detergent dispensing means. In its preferred form, the automatic dispensing interlock mechanism of the instant invention is designed for installation in the interior or bottom hinge door of a dishwasher and comprises a rinse aid dispensing means having a storage reservoir and a detergent dispensing container located in close proximity thereto. The interlock mechanism includes a spring biased rotatable shaft having a unitary detent member attached for rotation therewith. This detent member includes a first and second latching arm operative to be held by the timer controlled cam follower at preselected times in the washing and rinsing operation, and also includes a control arm operative to activate and deactivate the rinse aid dispensing means. The cam and cam follower of the timer control unit are designed so that the rinse aid dispenser is not activated when the timer control knob is manually advanced.

With the device of the present invention the timer mechanism can run through the normal "rinse and hold" cycles and return to start without affecting the activation of the rinse aid dispenser. This results from not closing the detergent cup cover since detergent is not provided during the rinse and hold cycle, and therefore the timer mechanism and the interlock mechanism remain operatively disconnected.

A detergent and rinse additive interlocking dispensing apparatus is thus provided wherein both detergent and rinse additives are dispensed at the proper preselected time in the washing and rinsing cycles, and which has the additional advantage of preventing the release of rinse additives provided the detergent cup cover remains in the open position. It is a further object to provide a mechanism in which the rinse additive dispensing device is not activated during a manual advancing of the timer control unit.

BRIEF DESCRIPTION OF THE DRAWINGS

Other features and advantages of the invention will be apparent from the following description taken in conjunction with the accompanying drawings wherein.

DETAILED DESCRIPTION OF THE INVENTION

Figure 1:
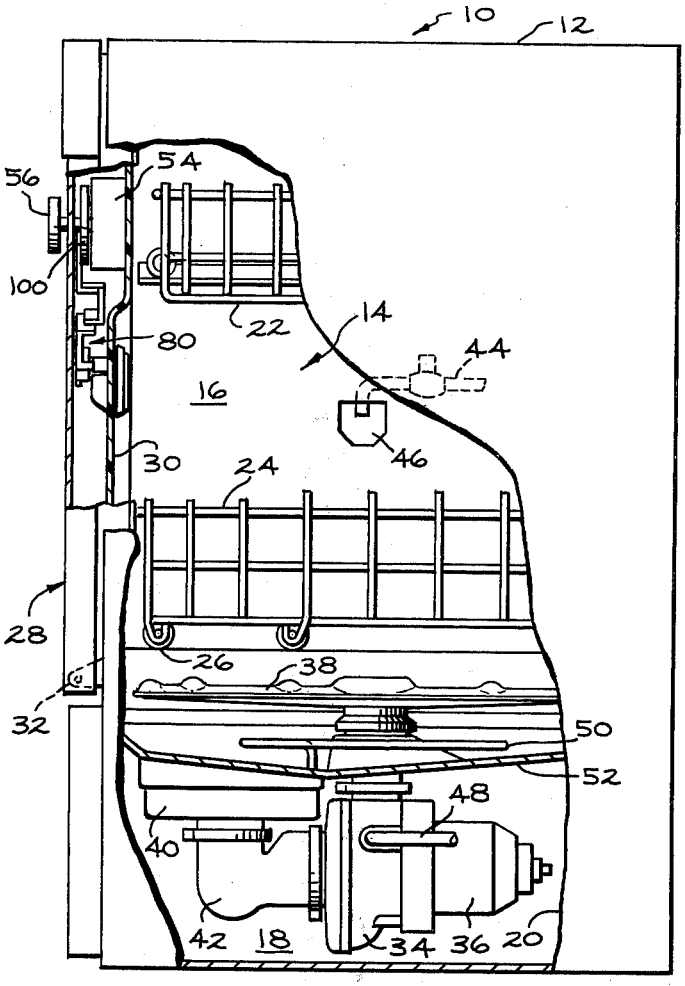
FIG. 1 is a side sectional elevational view of a dishwasher having dispensing structure embodying the invention, with portions of a dishwasher cut away to facilitate the illustration thereof.

FIG. 1 shows somewhat schematically an automatic dishwasher of a conventional domestic type. The dishwasher 10 includes an outer cabinet 12, and a tub 14 which forms the washing compartment 16 and a machinery compartment 18. The walls 20 of the machinery compartment are formed of metal. The tub 14 may be formed as a one piece structure of plastic or other heat deformable material, such as polypropylene, and is supported on the side walls 20 of the machinery compartment.

Racks 22 and 24 for supporting articles to be washed are mounted within the tub 14. The racks are mounted on rollers, one of which is shown at 26 for permitting the racks to be pulled outwardly of the cabinet to facilitate loading of the articles therein. The tub is provided with a bottom hinged door 28 which is pivotable between its substantially vertical closed position and an open position in which the inner panel 30 of the door is substantially horizontal. The door is supported on hinges 32. As is well known, the dish racks are arranged to be drawn from the tub when the door 28 is open.

In the machine compartment 18 there is disposed a pump 34 which is driven by an electric motor 36. The pump is connected by a conduit to supply water to the reaction type spray arm 38 which is arranged to eject a spray of washing or rinsing fluid over the articles in the dishwasher in a conventional manner. Water flows to a sump 40 from which it is returned to the pump through a conduit 42. Water for operation of the dishwasher is supplied as needed from a regular household water line, indicated at 44. The water is delivered into a fill funnel 46 from which it overflows into the tub and collects in the bottom of the tub. The pump then circulates the water through the spray arm and back through the sump for a period of time sufficient to adequately wash and rinse the articles in the dishwasher. After each washing or rinsing operation is completed the water is discharged by the pump through a conduit 48.

While articles may be dried by merely circulating air thereover, dishwashers are frequently provided with a heating element for insuring complete drying of the articles washed therein. This heating element indicated at 50 in the drawing is positioned near the bottom wall 52 of the dishwasher tub and air heated thereby flows upwardly to effect drying of the articles in the dishwasher. The heating element is conventionally of the sheathed type such as that sold under the trademark Calrod ®.

The dishwasher has mounted within the door 28 a programmed time cycle controller 54 used to institute an operational program which may include various washing and rinsing operations. The time cycle controller is activated by the user by turning the knob 56 protruding from the front of the dishwasher door. When the dishwasher is loaded and a suitable quantity of detergent added, the door is closed and the user activates the time cycle controller to institute an operational program. During the washing and rinsing operations the pump 34 forces water from the sump 40 up through the spray arm 38 which in turn sprays the articles within the tub. At the end of each washing and rinsing operation the spent liquid is drained from the tub. After a suitable drain interval at the end of the final rinsing operation the heater 50 is energized to dry the washed articles by evaporation of the liquid remaining therein.

The addition of wetting agents and other additives to the final rinse water to improve the drainage of the rinse water from the items being washed is quite common since this minimizes the retention of small rinse water droplets on the washed items which in turn causes spotting due to mineral precipitation on evaporation of the droplets.

The present invention provides apparatus for dispensing both detergent and rinse aid additives into a wash chamber of an automatic washing machine such as that described above in response to a programmer-timer control unit such as unit 54. In the following description of the detergent dispensing mechanism the same reference numerals were used in copending commonly assigned applications Ser. No. 798,969 and Ser. No. 798,972 and separately inventive structural and functional elements of this device can be obtained by reference to said applications. In the description of the rinse aid dispenser similar structures have the same reference numerals as contained in commonly assigned copending application Ser. No. 798,932 except that the numerals of Ser. No. 798,967 in this application are preceded by the numeral 1. For details of the rinse aid dispensing device reference can be made to that application.

In the drawings the detergent dispenser is referred to generally by the numeral 96 and the rinse aid dispenser is referred to generally by the numeral 98. Similarly, the interlock means comprising a rotating shaft and detent structure having various radially extending arms and latching members is referred to generally by the numeral 80. The primary differences in structure from that shown in commonly assigned copending applications Ser. Nos. 798,969 and 798,972 are the placement of the rinse aid reservoir 130 in close proximity to the detent member 82, and the addition of radial extension 120 to the unitary rotatable member 82. Also as will be described herein, the cam 100 has been designed so that its manual advancement at a rotational speed much greater than that generated by the timing device 54 does not activate the rinse aid dispenser 98 since the cam and cam follower "override."

Figure 3:
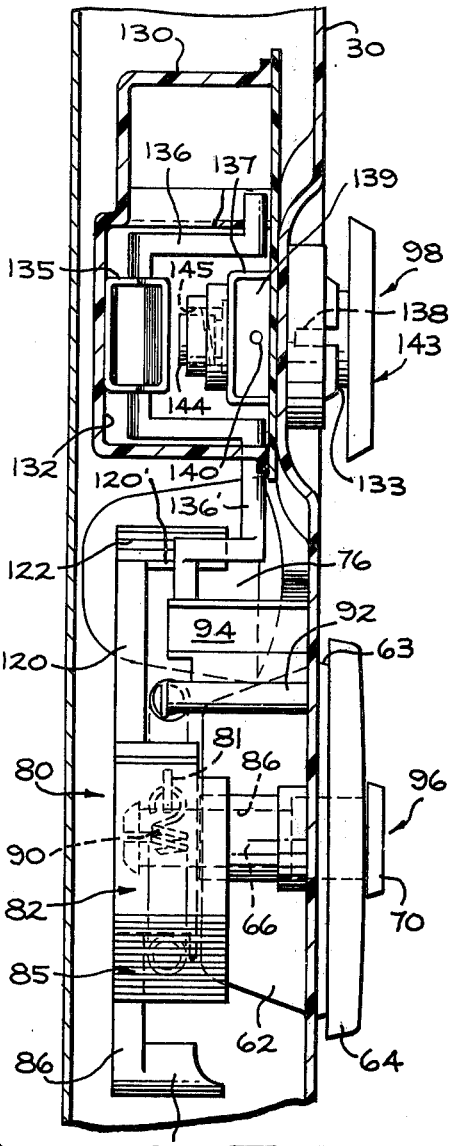
FIG. 3 is a top sectional view of the detergent and rinse additive dispensing structures.
Figure 2:
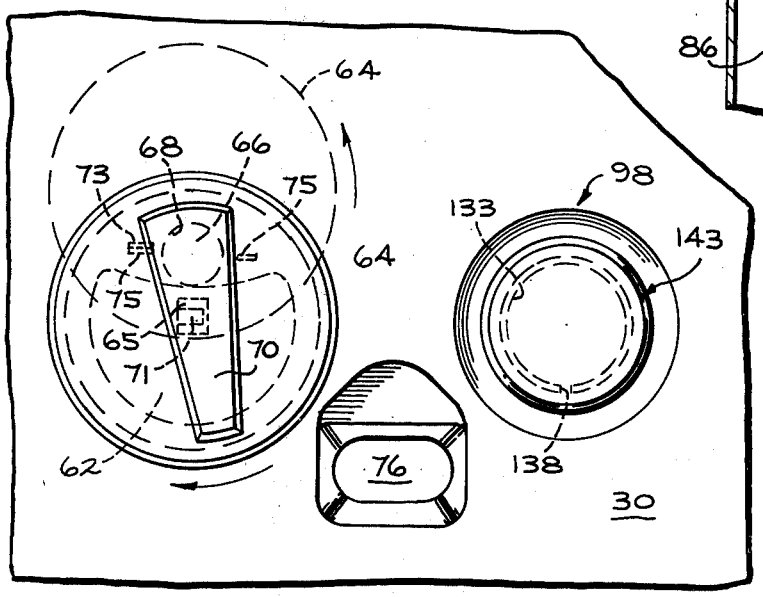
FIG. 2 is a plan view of the detergent and rinse additive mechanisms in a door open position.

In reference to FIGS. 2 and 3, the detergent dispenser 96 comprises a generally semi-spherical container 62 formed in the wall 30 of the dishwasher door 28. The dispenser includes a cover member 64 mounted to and adapted for rotation about a shaft 66. Shaft 66 is journalled in an opening 68 formed in the dishwasher inner door wall 30. Shaft 66 has a handle portion 70 formed integrally thereon. Cover 64 and handle 70 are interconnected by means of a slot 65 formed in the cover 64 and a pin 71 projecting inwardly into the cover 64 from the handle 70. Both the slot 65 and the pin 71 are inclined forming a camming surface which forces the cover 64 in an axial direction, as shown in FIG. 3, into engagement with a circular projection 63 of inner door wall 30 when the handle 70 is moved in a clockwise direction as shown in FIG. 2. The cover 64 is prevented from further rotation by the abutment of a stop 73 which projects from the door wall 30 and a shoulder 75 formed on cover 64. Conversely, when handle 70 is moved in a counter clockwise direction the inclined pin 71 reacts against the inclined surface 65 lifting the cover 64 off the projection 63 before the handle turns to its open position as shown in phantom in FIG. 2. Cover 64 has an annular channel formed therein for receiving a resilient circular rubber seal or gasket (not shown). This structure is shown in more detail in commonly assigned copending application Ser. No. 798,972.

Referring to FIG. 2, it can also be seen that the inner door wall 30 has an open detergent receiving container 76 formed therein in close proximity to container 62.

Shaft 66 and its integral handle 70 are preferably formed from a plastic material such as polypropylene and is sealed from the interior of the dishwasher by a seal member (not shown).

Figure 4:
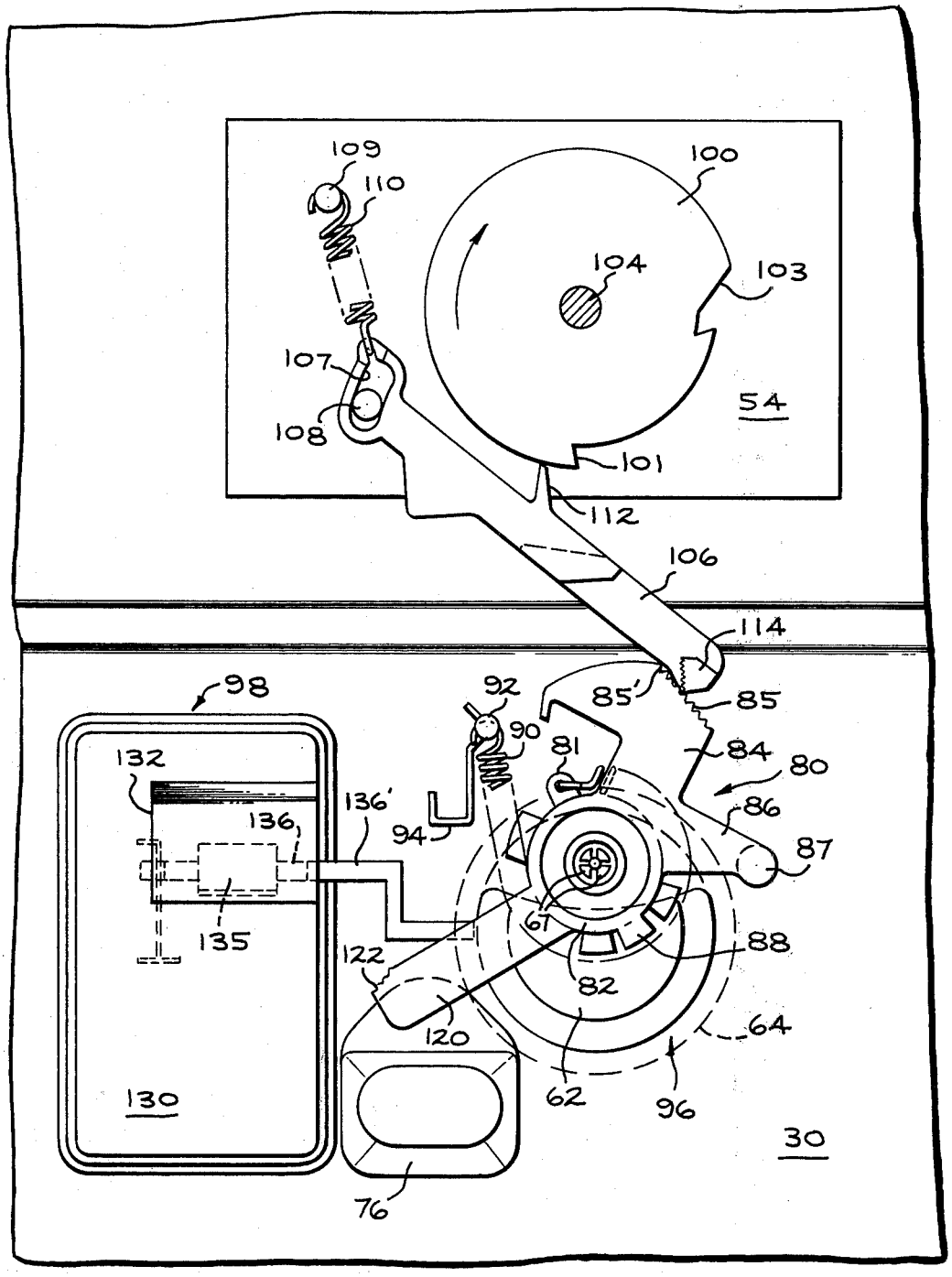
FIGS. 4 and 5 are front elevational views of the detergent and rinse additive dispensing interlock structure as they would appear with the outer door panel removed.

Referring to FIGS. 3 and 4, the interlock means 80 will be described. The interlock consists of a generally circular member 82 having a plurality of radial projections formed thereon, 84, 86, and 120. This member is also preferably fabricated from a plastic material and is mounted for rotation with shaft 66 by means of compressible locking members 67 formed in shaft 66 at its terminal end. Radial projections 88 formed on member 82 serve to retain a spring 90 wrapped circumferentially around member 82 and connected to projection 81 of member 82 and to pin 92 which extends from the inner door wall 30. Thus, spring 90 causes the shaft 66 and therefore the cover 64 to be biased in a counter clockwise rotational direction (in reference to FIG. 2) toward the open dotted position. Radial extension 84 of member 82 has a plurality of grooves or teeth 85 formed thereon extending in an axial direction as better seen in FIG. 3. The grooves 85 are formed so as to oppose the clockwise rotation of member 82 (as seen in FIG. 4) by reaction of a locking device such as the projection or pawl 114 of cam follower 106. Similarly, grooves 122 formed on radial extension 120 are also caused to be held by pawl 114 as is better seen in reference to FIG. 5. Radially extending control arm 86 has a shoulder 87 formed thereon for reacting against a dispensing arm 136′ of the rinse aid dispenser 98, and as shall be described below, (as shown in phantom in FIG. 5) holds the dispensing arm and the detent member 82 from rotation by means of a stop member 94 formed integrally with and projecting from wall 30.

Cam member 100 is mounted for rotation with shaft 104 of control unit 54 and moves in a clockwise direction as shown in FIG. 4. Cam 100 has two recessions formed therein, 101 and 103 for reasons which will be later described. The camming surface 103 is designed so that upon rotation of the cam member 100 at a speed greater than that caused by the timer control unit 54 (which is approximately one revolution per hour) such as may occur by manually advancing the timer mechanism (which may be for example at a speed of approximately one revolution in ten seconds) the projection 112 of the cam follower 106 will "override" the recession thereby not affecting the engagement of pawl 114 with grooves 122 of member 120. Mounted adjacent cam 100 is the cam follower 106 having a slot 107 formed therein for connection to a pin 108 which projects from the timer control escutcheon of the door 28. Connected to slot 107 at the upper portion thereof is a spring member 110 fastened to a pin 109. Cam follower 106 which is also preferably fabricated from a plastic material such as polypropylene has a projection 112 formed thereon for tracking the rotation of cam 100. Formed at the other terminal end of follower 106 is the pawl 114 adapted to engage the grooved surface 85 of detent member 82 and 122 of member 120.

Figure 5:
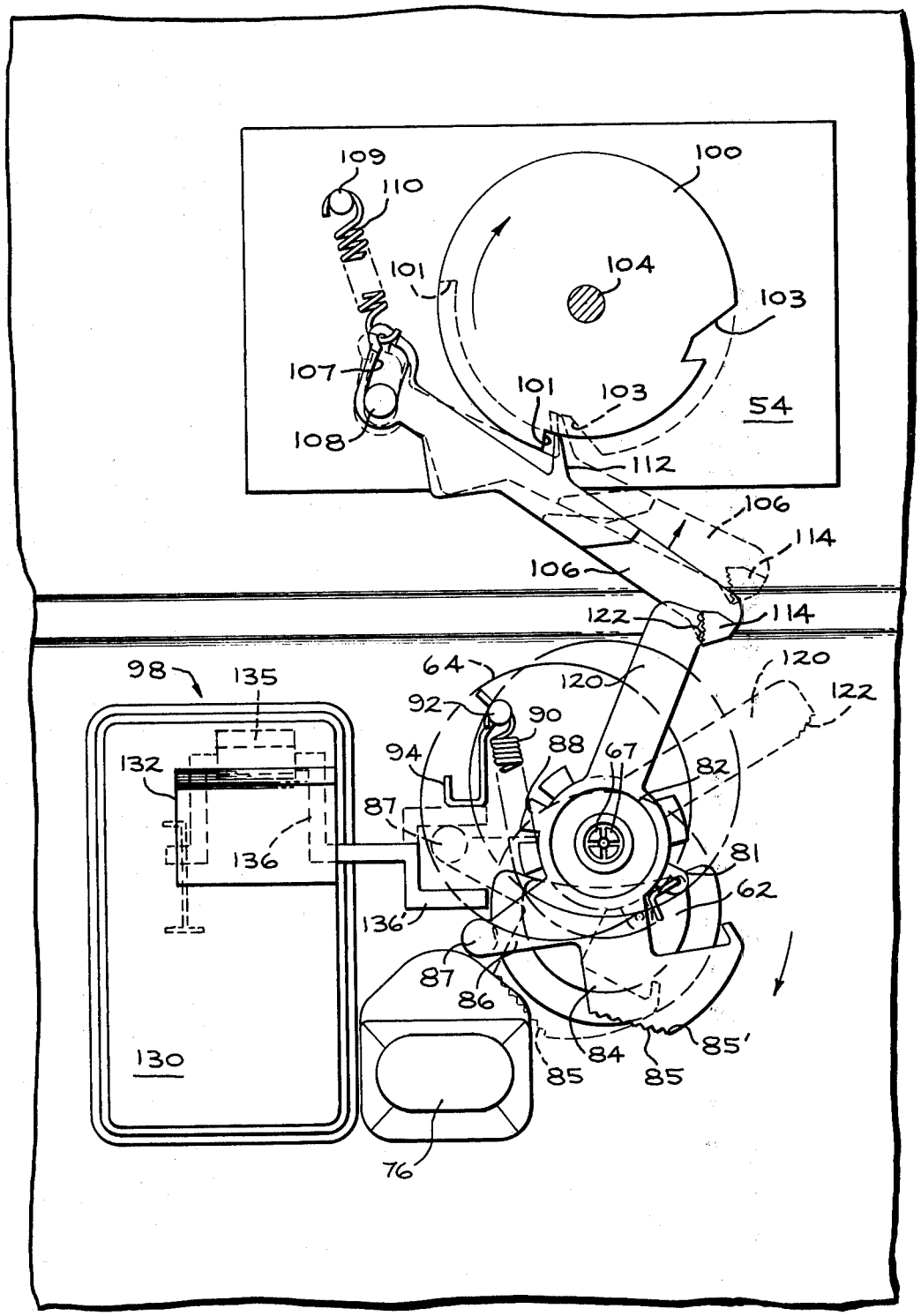

As can be seen by reference to FIG. 5, cam follower 106 is permitted to rotate in a counter clockwise direction when the projection 112 falls within the recesses 101 and 103 of cam member 100. When this occurs at a first and a second predetermined time in he wash cycle, respectively, projection or pawl 114 is lifted from the grooves 85 of latching member 84 and from grooves 122 of latching member 120 and the spring 90 causes the detent member 82 to rotate in a clockwise direction until the shoulder 87 forces the dispensing arm 136′ against the stop 94. When the latching member 84 is released by cam follower 106 the detergent cup cover 64 moves into an open position as shown in phatom in FIG. 2 and member 82 rotates in a clockwise direction until latching member 120 comes into contact with member 106. At a later time in the rinse cycle corresponding to the final rinse, cam follower 106 once again moves upwardly when the projection 112 falls within 103 causing latching member 120 to be released thereby causing shoulder 87 of control arm 86 to move the dispensing arm 136′ upwardly into dispensing position and into engagement with stop 94. It should be noted that control arm 86 of detent 82 is spaced from the radial extension 120 such that shoulder 87 does not rotate dispensing arm 136′ until radial extension 120 is released by cam follower 106. This is best shown by reference to FIG. 5. In reference to FIG. 3 it can be seen that the teeth 122 are formed on an axial extension 120′ of member 120, thus, as member 120 rotates in a clockwise direction into engagement with cam follower 106 it does not engage the dispensing arm 136′.

The rinse aid dispensing structure 98 will now be described. The novel rinse aid dispensing unit 98 as was mentioned above is more fully described in reference to commonly assigned copending application Ser. No. 798,932. As shown in FIGS. 3 and 4, the dispenser 98 comprises a generally rectangular container 130, arranged to be mounted within a dishwasher door 28. Advantageously, the dispenser can be designed to act as a signal between the inner and outer panel of a door 28 so as to prevent excessive defection of the inner door panel 30 in the event heavy articles are placed on the open door. The dispenser may be mounted by any suitable means.

As shown, the dispenser 98 consists of a generally rectangular main body part 130 which defines a reservoir for the liquid additive contained therein. The main body part 130 contains a sump 132 located closest to the outer door panel such that when the dishwasher door 28 is in the open position, sump 32 is in the lowest portion of the liquid additive reservoir defined by the main body part 130. The main body part 130 may be made of any suitable material but preferably would be of molded plastic impervious to the liquid additives and non-corroding as are the other parts of the dispenser.

Liquid additive is charged to the main body part 130 through fill opening 133 which protrudes from the inner panel 30 of the dishwasher door. The fill opening 133 is conveniently fitted with a closure device 143 to prevent leakage of water into the body part 130 during operation of the dishwasher and to prevent leakage of additive into the dishwasher. Closure device 143 consists of an elongated member 144 threadably and sealingly received within opening 145 of filling means 132. The opening 145 is appropriately located so that it is always above the liquid additive level whether the door be opened or closed so as to avoid any leakage of liquid additive into the washing chamber. Although only one type of closure device is shown it can be appreciated that other devices could also be employed.

The measuring and dispensing device is located within the confines of main body part 130. In its broadest terms, it consists of a measuring cup 135 which is of predetermined size and rotatably mounted for movement between a filling and a discharge position by means of a pivot arm 136. In the filling position measuring cup 135 is positioned within the sump 132 and is submerged in liquid additive when the dishwasher door 28 is in the open position. Upon closing the dishwasher door 28, the main body part 130 is rotated through approximately 90 degrees which causes the liquid additive in sump 132 to flow therefrom to the now lower portion of the main body part 130. At this point measuring cup 135 remains in the fill or normal position as shown in FIG. 3 and contains a precise quantity of liquid additive.

At the proper preselected time in the wash cycle, that is, when cam follower 106 falls within the recess 103 thereby releasing the latching member 120 as shown in phantom in FIG. 5, the measuring cup 135 is caused to move to its discharge position above the discharge conduit 137 and discharge a precise quantity of liquid additive. The means for moving measuring cup 135 between its fill and discharge positions can be of any conventional design, but preferably the means should be as simple as possible so as to achieve both economic and long lasting benefits. This of course is a feature of the interlock structure 80. It is preferred to mount measuring cup 135 to pivot arm 136 which rotates about an axis remote from the measuring cup 135 as shown in FIG. 3 thereby advantageously controlling the movement between the fill and discharge positions. It is also preferable to have the measuring cup 135 fixedly attached to the pivot arm 136 so that pivoting of the pivot arm 136 automatically pivots the measuring cup 135 thereby causing a precise quantity of liquid additive to be discharged into the discharge conduit 137 when the cup is rotated to the discharge position.

At the discharge position the precise quantity of liquid additive is discharged by gravity from the measuring cup 135 into discharge conduit 137 through which the liquid additive flows by gravity to exit port 138 of fill opening 133 and thence into the dishwasher tub 14. Discharge conduit 137 is a generally elongated stationary structure in substantially a vertical position when the dishwasher door is closed. In this position the upper end of discharge conduit 137 has an opening to receive the liquid additive discharged from the measuring cup. The interior lower end portion of the discharge conduit 137 is open to fill opening 133 which in turn is in communication with the interior of the washing chamber to exit port 138. Discharge conduit 137 might also have a restricted portion intermediate the ends thereof for preventing leakage from the washing chamber into the liquid additive reservoir. The drawings illustrate this feature by cylindrical wall 139 having small aperture 140 therethrough located between the upper opening of the discharge conduit and exit point 138.

It should be noted that the top of the discharge conduit 137 is positioned so as to always be above the level of the liquid additive in the main body part 30 regardless of the door position. This of course eliminates all possibility of leakage of liquid additive into the washing chamber.

Operation of the novel multiple dispensing mechanism and interlock device shall now be described. The operator opens the dishwasher door 28 and loads the dishes to be washed in the racks 22 and 24 in suitable fashion. At this time, the door 28 is in the substantially horizontal position and the detergent container 62 is uncovered. That is, the detergent cup cover 64 is positioned as shown in phantom in FIG. 2. The operator then places detergent into the detergent cup 62 and into the open recess 76 in the dishwasher door. Handle 70 is then moved in a clockwise direction as shown in FIG. 2 into the closed position shown in FIG. 2 and FIG. 3. By this motion any excess detergent which may have been placed in container 62 is sheared off by the rotating motion of the cover 64. At this time, the cam follower 106 engages the detent member 82 by inter action of the projection 114 and the grooves 85 of the latching arm 84. Grooves 85 of member 84 begin at point 85', which point is selected such that follower 106 does not engage arm 84 until there has been minimally acceptable compression of seal 74 within cover 64, thereby assuring an affective seal of container 62. Spring 110 holds follower 106 in engagement with grooves 85 by pivoting about projection 112 which serves as a fulcrum. As the operator moves the handle 70 further in a clockwise direction the pin 71 is caused to react against the inclined slot 65 in the cover 64, forcing the cover in an axial direction into tighter sealed engagement. This additional rotational motion causes the pawl 114 to move slightly further along the grooved surface 85 as detent member 82 moves in a counter clockwise direction as seen in FIG. 4. The engagement of the projection 114 and the grooves 85 hold the handle in the position shown in FIG. 3. The circumferential dimension of the grooved portion of member 84 is designed so as to permit wide manufacturing and assembly tolerance variations.

While the door 28 is in the open position the operator might also remove the closure device 143 of the rinse aid dispenser 98 to determine whether the reservior has a sufficient quantity of rinse additive therein.

The detergent in the stationary open cup 76 is normally used in the first wash. There are then noramlly one or more rinses. This of course depends upon the operator setting of the control knob 56 which is connected to the timer control unit 54. At the beginning of the second wash cycle the cam 100 has moved into the position shown in solid section in FIG. 5. At this time the projection 112 of cam follower 106 is caused to slide into the recess 101 under the upward force of spring 110, causing pawl 114 to move upwardly and away from the grooves 85 of radial extension 84 of the detent member 82. As this occurs, the detent member 82 moves in a clockwise direction (FIG. 5) which in turn causes cover 64 to move in a counter clockwise direction as shown in FIG. 2 thereby uncovering the detergent cup 62. The detent member 82 will rotate in a clockwise direction until latching member 120 engages the member 106 as shown in solid section in FIG. 5. The detergent within the detergent container 62 is then allowed to mix with the second wash water for a more thorough washing of the dishes contained therein.

When the second wash is over and one or more rinses have been made cam 100 would then have moved into the dotted position shown in FIG. 5 wherein projection 112 of cam follower 106 is permitted to move into the recess 103 thereby releasing the latching member 120. As this occurs the control arm 86 having shoulder 87 formed thereon is permitted to move in a clockwise direction as shown in dotted section in FIG. 5 thereby moving the rinse aid dispensing arm 136' upwardly against the stop 94 which in turn causes the rinse additive to flow through discharge conduit 137 into the final rinse water. When the final rinse has been completed the Calrod heater is normally energized to dry the dishes. Note that the detergent cup cover remains in the open position as shown in phantom in FIG. 2 and the detent member 82 remains in the dotted position shown in FIG. 5 holding the dispensing arm 136' upwardly against the stop 94.

Thus, if in the next wash cycle the operator selects what is called the "rinse and hold" cycle, whereby the dishes are merely rinsed, no detergent being used since there is no washing performed, cover 64 will remain in the open position which means that the rinse aid cup 135 is held over the discharge conduit 137 and in an inoperative position, regardless of the number of times the door may have been opened and closed. Thus, an effective interlock detergent and rinse aid mechanism has been shown of economical construction which assures that the rinse aid dispensing device will remain inoperative so long as the detergent cup cover remains in open position.

Also as has been described above, recess 103 of cam 100 is designed so that the operator may move the timer control knob 56 manually advancing cam 100 without activating the interlock arm 120, even if the cover 64 has been closed. Of course, the various latching mechanisms and the timer cam are operatively disconnected until the detergent cup cover has been moved from its open to its closed position.

It should be appreciated that although the mechanism disclosed herein is uniquely inventive, the design is relatively simple having relatively few moving parts, thereby lending itself to fabrication by inexpensive plastic injection molding techniques. One skilled in the art will appreciate also that modifications will be made to the invention without departing from the spirit of it.

The embodiment of this invention in which an exclusive property is claimed are defined as follows:

1. Apparatus for dispensing multiple additives into a wash chamber of an automatic washing machine, the operational cycles of the machine being controlled by a programmer-timer control unit, and wherein the machine includes detergent dispensing means and rinse additive dispensing means operatively controlled by said control unit, said detergent dispensing means including a container and a cover therefor movable between an open and closed position, the improvement comprising:

interlock means operatively interconnecting said detergent and said rinse additive dispensing means with said timer control unit, said detergent container being opened by movement of said cover in response to said interlock means at a first preselected time, said rinse additive dispensing means being caused to dispense rinse additive in response to said interlock means at a second preselected time, said rinse additive dispensing means being held in an inoperative mode by said interlock means after said second preselected time and until said cover is moved to said closed position; wherein said interlock means comprises:

a shaft member jounralled in the inner wall of the washing machine door, said shaft connected to said detergent dispensing cover;

detent means mounted for rotation with said shaft interior of said inner door wall, said detent means including first and second latching means radially spaced each from the other, and a radially extending rinse dispenser control arm, said detent means having spring biasing means operative to rotate said shaft and said cover into an open position; and cam means including a cam follower, operatively connected to said timer control unit, said cam follower including pawl means for engagement with said first and second latching means;

whereby said first latch means engages said pawl means when said cover is moved to its closed position and is released by said pawl means thereby opening said cover at said first preselected time, said second latching means engaging said pawl means when said first latching means is released, said second latching means being released by said pawl means at said second preselected time thereby causing said rinse dispenser control arm to activate said rinse additive dispensing means, said rinse additive dispensing means being held in an inoperative mode by said detent means after said second preselected time and until said cover is moved to said closed position.

2. The combination of claim 1 wherein said first and second latching means comprise radially extending arms of said detent means, said latching means including a pluraltiy of axially extending teeth at their radially terminal ends for connection to said pawl means of said cam follower.

3. The combination of claim 1 wherein said cam means comprises a generally circular member mounted for rotation in response to said timer control unit, the circumferential surface of said member having a plurality of radially extending recesses formed therein and adapted to receive a projection of said cam follower, said follower and said recesses operative with said pawl means to release said first and second latching means at said first and second preselected times in the operational cycle.

4. The combination of claim 3 wherein said cam member and said cam follower operatively interact such that revolution of said cam member at a rotational speed substantially greater than that caused by said timer control unit will cause the follower to override one of said recesses thereby not releasing said second latching means.

5. Apparatus for dispensing multiple additives into a wash chamber of an automatic washing machine having a programmer-timer control unit, first additive dispensing means having a storage reservior for storing a first additive, additive measuring and dispensing means operable between a first position immersed in the first additive in the door open position and a second dispensing position over a discharge means when in the door closed position, said dispensing means including an extended dispensing arm; second additive dispensing means having a storage container formed in the door adjacent said first dispensing means for storing a second additive, said second additive dispensing means further having closure means movable between a first uncovered position and a second sealed position over said container, said closure means being in communication with said timer control unit through a rotating cam means and a first latching device, said device located proximate to said dispensing arm, the improvement comprising:

a second latching device operatively connected to said first latching device and said cam means so that when said first latching device is released by said cam means thereby opening said second additive container at a first perselected time, said second latching device engages said cam means until separately released at a second preselected time in the wash/rinse cycle, said second latching device including a control member for engaging said dispensing arm thereby activating said arm for dispensing said first additive when said second latching device is released by said cam means, and said cam means including means for overriding the release of said second latching device when said cam means rotates at a speed substantially greater than that experienced under the control of said timer control unit, whereby rapid rotation of said cam means resulting from operator rotation of the timer control unit avoids dispensing of said first additive.

6. The apparatus of claim 5 further including a stop member mounted adjacent said second latching device, said second latching device being spring biased thereby operatively engaging said dispensing arm with said stop member after being released by said cam means at said second preselected time.

7. The combination of claim 5 wherein said first latching device and said cam means are operatively disconnected until said closure means is moved from said first to said second position.

* * * * *